United States Patent [19]

Drechsel

[11] Patent Number: 4,531,674

[45] Date of Patent: Jul. 30, 1985

[54] IMPACT IRRIGATOR WITH CONTROLLED RETURN

[76] Inventor: Arno Drechsel, Via Weggenstein, 29, 39100 Bolzano, Italy

[21] Appl. No.: 506,359

[22] Filed: Jun. 21, 1983

[30] Foreign Application Priority Data

Jun. 24, 1982 [IT] Italy ..... 46837 A/82

[51] Int. Cl.[3] ..... B05B 3/16

[52] U.S. Cl. ..... 239/230; 239/232; 239/233

[58] Field of Search ..... 239/230–233

[56] References Cited

U.S. PATENT DOCUMENTS 3,623,666 11/1971 Meyer ..... 239/233 X 4,231,522 11/1980 Drechsel ..... 239/233

FOREIGN PATENT DOCUMENTS 40866 12/1981 European Pat. Off. ..... 239/230

*Primary Examiner*—Andres Kashnikow

*Attorney, Agent, or Firm*—Birch, Stewart, Kolasch & Birch

[57] ABSTRACT

An impact irrigator with controlled return, which comprises a rapid return deflector (28) disposed at the end of a lever (27) which rocks in the vertical plane to the side of the propelling tube (1), and is controlled by a motion reversal linkage (20, 19, 21, 24, 25, 26), the rocker lever (27) being slidably mounted on its pivotal shaft (77) in such a manner as to move along the shaft (77) and away from the propelling tube (1) when the deflector (28) is immersed in the jet; elastic reaction and repositioning elements (34) for the lever (27) are provided, and this latter comprises a cam (36) arranged to rest on the jet outlet nozzle (13) in order to regulate the degree of immersion of the deflector (28) as a function of the movement.

4 Claims, 5 Drawing Figures

IMPACT IRRIGATOR WITH CONTROLLED RETURN

This industrial invention patent relates to improvements in impact irrigators.

Known impact irrigators, whether mounted on tripods or not, comprise a vertical irrigation water feed column; an inclined propelling tube rotatably mounted on said column by way of an adjustable brake; a mobile assembly which swings relative to the propelling tube; interchangeable jet deflector means disposed at the front end of the swinging mobile assembly and arranged to interfere cyclically with the jet in order to urge the propelling tube to rotate with jogging movement about the column axis; a deflector for the rapid return of the propelling tube and provided at the end of a rocker lever which is pivoted to this latter; and a motion reversal device arranged to cause said lever to make rocking movements in order to insert and extract the rapid return deflector into and from the water jet leaving the propelling tube nozzle. Said motion reversal device is operated by a mobile appendix disposed lowerly on the launching tube and arranged to make contact, on termination of the outward and return travel of the propelling tube, with movable stops disposed at the top of the irrigation water feed column.

As they sink into the jet, the rapid return deflectors are struck by a constant fraction of the jet, so that the irrigator return speed is often too high, and is therefore also dangerous for the operator.

Moreover, when such impact irrigators are mounted on tripods and are used on rough and/or sloping ground, it often happens that because of said excessive speed they lose their stability and fall to the ground. In addition to interrupting irrigation, this can cause fracture of essential parts of the irrigator, and if action is not swiftly taken can also lead to considerable damage to the surrounding culture, considering the flow rate and pressure of the water leaving the nozzle.

The present patent provides and protects improvements in impact irrigators in general, which are able to obviate the aforesaid drawbacks by means of a simple, rational, functional and extremely reliable design.

This object is attained according to the invention by positioning the return deflector elastically relative to the jet, in such a manner as to allow it to undergo elastic adjustment in the tangential direction to enable it, under the action of the jet thrust, to move into a desired equilibrium position in which it receives only a fraction of said jet, this fraction being a function of the throughput.

This can be attained by mounting the rocker lever which supports the rapid return deflector on a horizontal slider which is orthogonal to the jet and is elastically urged to maintain the deflector within the jet.

Said slider is preferably mounted on the pivotal shaft of the rocker lever.

In this manner, according to the thrust generated by the jet on the deflector, this latter moves laterally to the jet into an equilibrium position between said elastic means and the tangential thrust component, to partially emerge from the jet.

Moreover, according to the invention said slider is disposed in combination with a cam rigid with the rocker lever and arranged to rest against the irrigator nozzle, in order to regulate the extent of immersion of the deflector into the jet in the vertical direction, as a function of the lateral movement of the cursor.

Summarising, the slider and cam regulate the extent of immersion into the jet both in the vertical plane and horizontal plane simultaneously, to enable these known types of impact irrigators to operate correctly with a practically constant return speed when mounted on a tripod, with any type of nozzle and any operating pressure.

The constructional and operational characteristics and merits of the invention will be more apparent from the detailed description given hereinafter with reference to the figures of the accompanying drawings, which show a particular preferred embodiment thereof by way of nonlimiting example.

Figure 1:
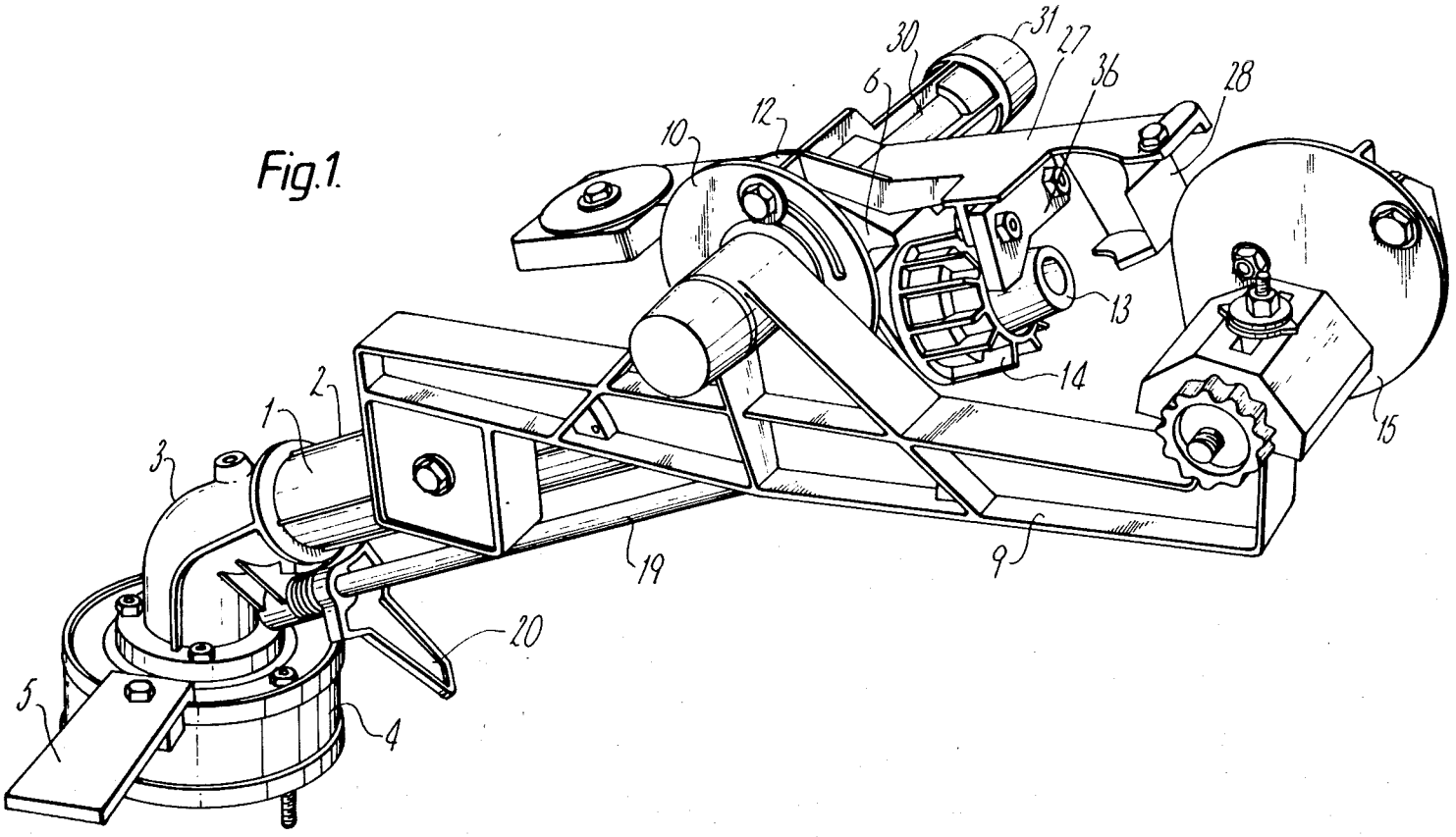
FIG. 1 is a perspective view of the improved impact irrigator according to the invention.
Figure 2:
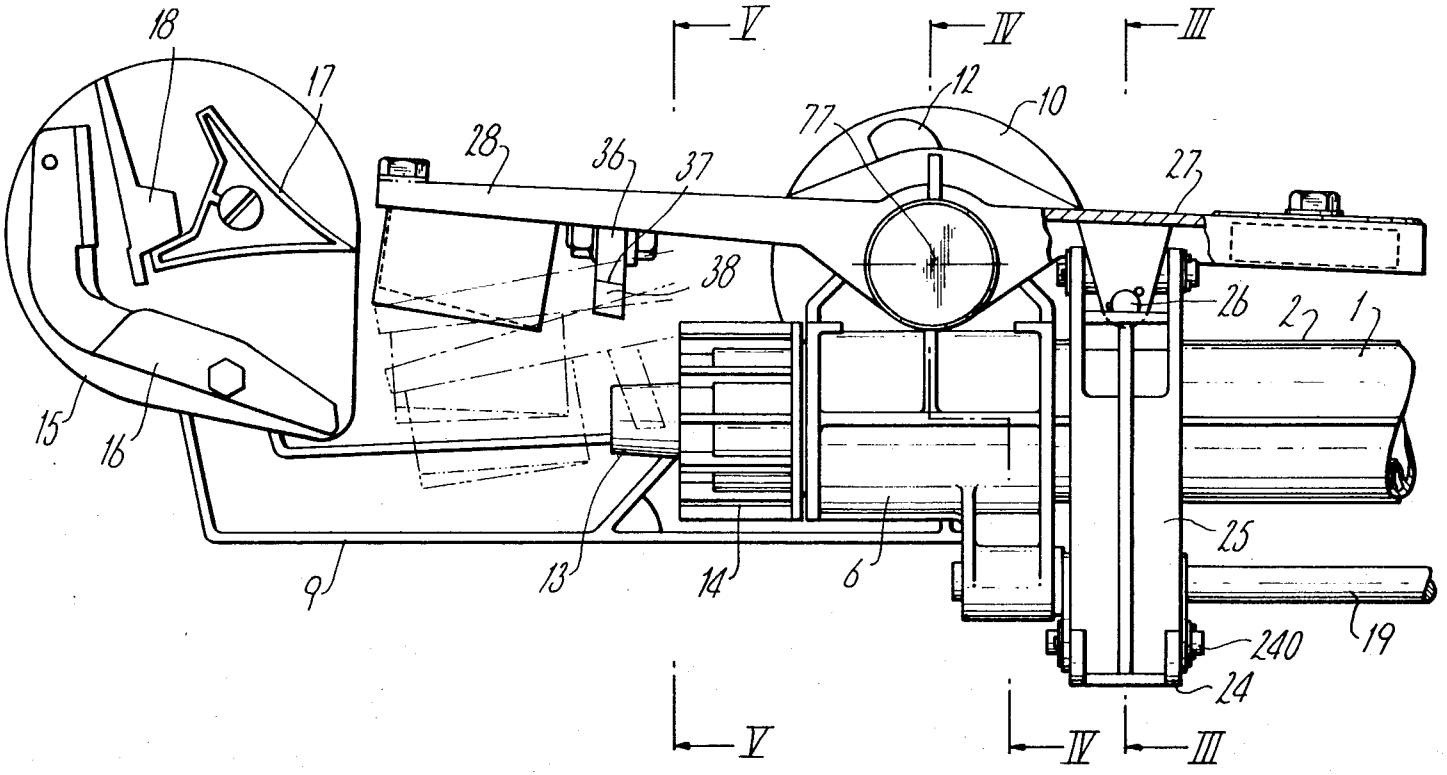
FIG. 2 is a side view of the front part of the same irrigator.

Said figures, and in particular FIGS. 1 and 2, show a propelling tube 1 provided externally with longitudinal ribs 2, and at its base with an elbow 3 comprising a rotating joint 4 provided with a self-adjusting brake.

The joint 4 is intended to be fixed to the top of a normal irrigation water feed column, not shown, and is provided at its upper portion with a ledge along which two stops 5 can be set for selecting the sector of irrigation.

The longitudinal ribs 2 act as antirotational members for a sleeve 6 which is fixed in a convenient position along the propelling tube 1.

Figure 4:
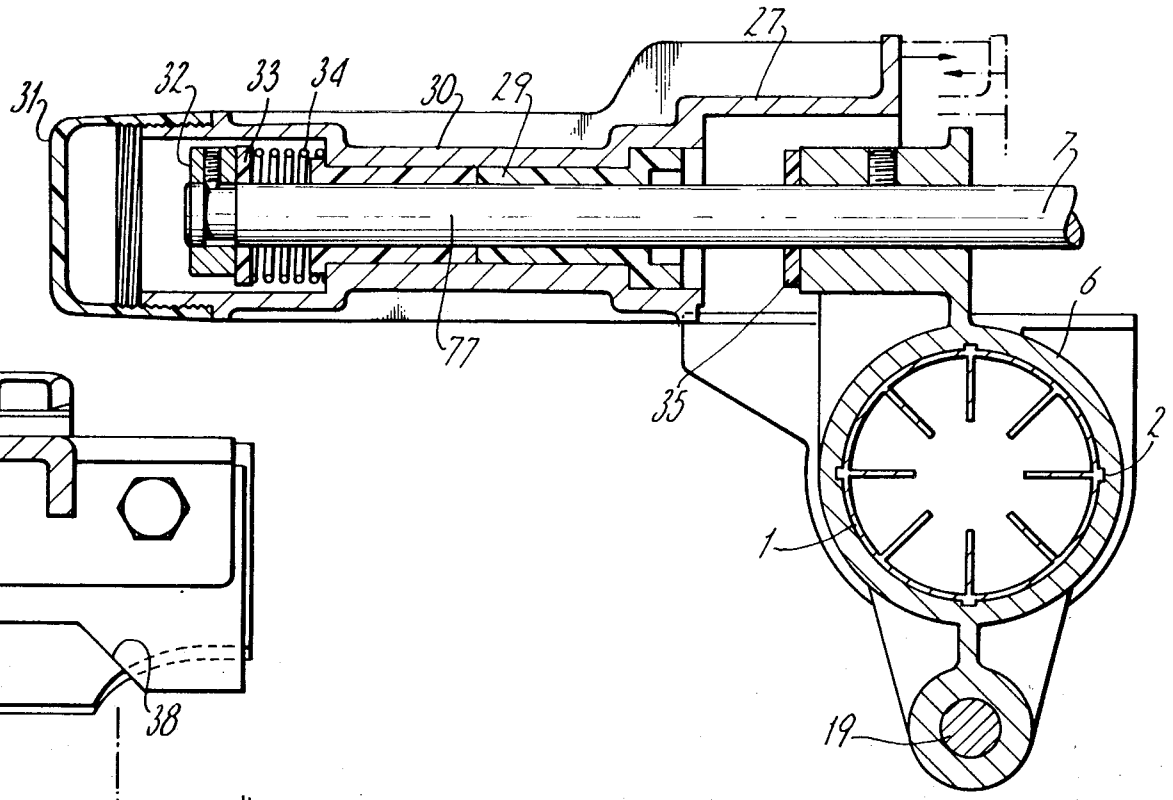
FIG. 4 is a section on the line IV—IV of FIG. 2.

As is clearly shown in FIG. 4, above the sleeve 6 there is fixed a horizontal transverse lateral shaft 7 on which there is rotatably mounted a mobile assembly which is arranged to swing parallel to the plane which contains the propelling tube 1 and the respective column.

The mobile assembly comprises a swing arm 9 conveniently counterweighted at its rear, and comprising a disc 10 provided with two swing limit stops, 11 and 12 respectively.

The stop 12 can be adjusted along an arcuate slot provided in said disc 10, as shown in FIG. 1.

The swing arm 9 extends beyond the free end of the propelling tube 1, where there are provided a nozzle 13 and a threaded sleeve 14 for fixing it to said propelling tube.

The front end of the swing arm 9 is bent upwards, where it supports a plate 15 on which a group of normal deflectors are mounted, and which can be adjusted transversely to the irrigation water jet according to the diameter of the nozzle 13 (FIG. 2).

The group comprises a main deflector 16 arranged to give the necessary tangential thrust to the propelling tube in order to cause it to move with a jogging motion during its outward travel, and constituted essentially by a twisted profiled fin.

The aforesaid group is completed by a secondary deflector 17 arranged to transmit the swinging movement to the swing arm 9, and constituted by a triangular concave-walled plate which can swing between two end positions defined by a rear stop member 18.

Said main deflector 16 and secondary deflector 17 can be of any other convenient type.

Below the propelling tube 1 there is rotatably mounted a spindle 19 provided at its rear with an appendix 20 (FIG. 1) arranged to make contact with the aforesaid appendices 5 in order to cause reversal of motion of the propelling tube 1 in known manner.

Figure 3:
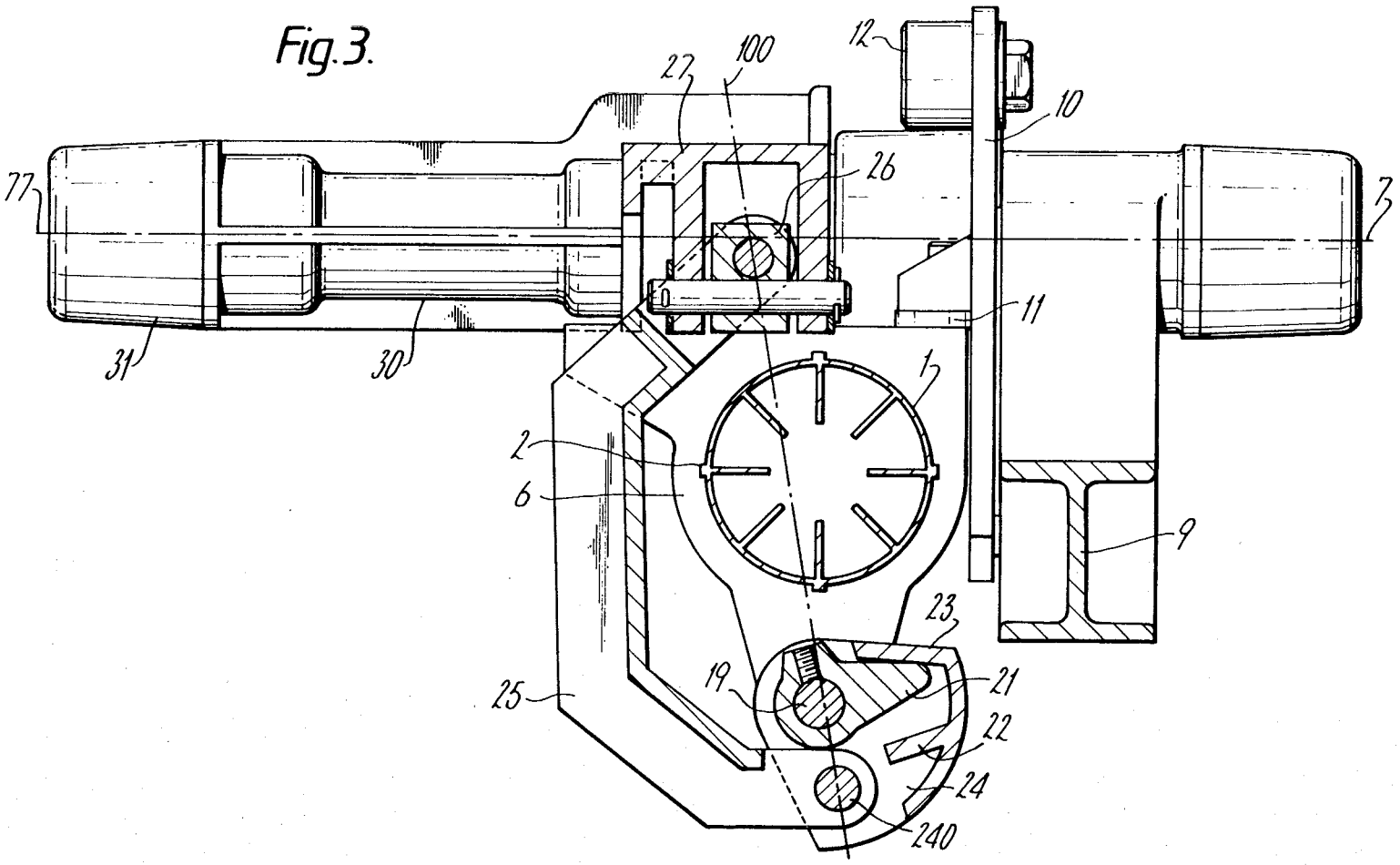
FIG. 3 is a section on the line III—III of FIG. 2.

As is clearly visible in FIG. 3, the front end part of the spindle 19 has fixed to it a profiled lever 21 which lies with a certain degree of slack between two opposing walls 22 and 23 respectively, of a member 24 which is rotatably mounted on the spindle 19.

To said member 24 there is lowerly pivoted at 240 a profiled connecting rod 25 which extends to the side of the propelling tube 1, on that side thereof which is opposite the side occupied by the swing arm 9.

The upper end of the profiled connecting rod 25 is bent inwards to lie above the propelling tube 1, where it is articulated, by means of a universal joint 26, to a rocker lever 27 which is rotatably mounted on a shaft 77 aligned with the shaft 7 and disposed on the other side of the propelling tube, as also shown in FIG. 4.

One of the axes of the universal joint 26 is practically parallel to the propelling tube 1, whereas the other axis is orthogonal thereto (FIG. 3).

As is clearly visible in the accompanying FIGS. 1, 2 and 3, the profiled connecting rod 25 is pivoted to the rocker lever 27 to the rear of the pivotal shaft 77 of this latter.

Moreover, from the accompanying FIG. 2 it can be seen that the rocker lever 27 is conveniently counterweighted at its rear, whereas its front end extends until it reaches the zone between the plate 15 and the nozzle 13, where it lowerly comprises a normal rapid return deflector 28.

This latter deflector can also be of different type, provided it is arranged for immersion into the jet on termination of each outward travel stroke in order to return the propelling tube to the commencement of the sector of irrigation.

At this point, with reference to the accompanying FIG. 3, it will be noted that the linkage provided for immersing the rapid return deflector 28 into the jet is in a below-centre position from which it can be removed only when controlled by the appendix 20, this therefore preventing the deflector 28 from being able to sink into the jet when the lever 27 is inadvertently struck. Said position is indicated in FIG. 3 by the straight line 100 which joins the upper axis of the universal joint 26 to the axis 240, and lies outside and beyond the axis 19.

As is clearly shown in said figure, when the irrigator is undergoing outward jogging movement, the deflector 28 then being completely extracted from the jet, the axis of articulation 240 between the box member 24 and the profiled connecting rod 25 is below said axis 19, so that no force acting on the rocker lever 27 will be able to immerse the rapid return deflector into the jet.

FIG. 4 shows that the rocker lever 27 is rotatably mounted on the shaft 77 by way of a suitable sliding bearing or bush 29, which can also slide axially relative to said shaft 77.

Said bush 29 is inserted in a hollow cylindrical member 30 which is rigid with the lever 27.

On the free end of the shaft 77, which is masked by a cover 31, there is mounted an anti-withdrawal ring 32, against which a compression spring 34 mounted on the shaft 7 rests by way of an antifriction washer 33.

The other end of said spring 34 presses against a shoulder on the hollow cylindrical member 30 so as to constantly force the rocker lever 27 towards the propelling tube 1.

A further antifriction washer 35 is provided between the bush 29 and sleeve 6.

Figure 5:
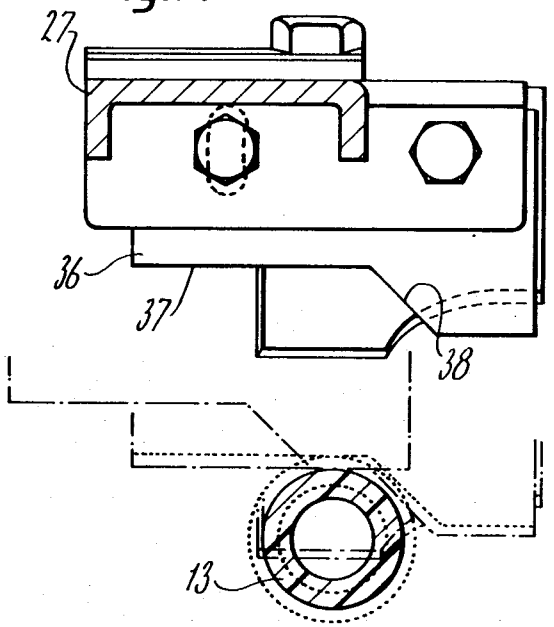
FIG. 5 is a section on the line V—V of FIG. 2.

Moreover, as can be best seen in FIGS. 1, 2 and 5, immediately upstream of the rapid return deflector 28, the rocker lever 27 comprises a cam 36 essentially constituted by an orthogonal transverse plate.

The active profile of said cam 36, which is constituted by its lower edge, comprises a horizontal inlet portion 37 and an inclined portion 38.

Said inclined portion 38 is inclined downwards and outwards, and is completely external to the common plane in which the nozzle 13 and column lie when the rapid return deflector 27 is excluded, the position being shown by thick lines in FIG. 5.

The same figure also shows that the cam 36 is adjustable relative to the lever 27.

When the propelling tube 1 reaches the end of an outward travel stroke, the deflector 28 is immersed into the jet by means of the elements 20, 19, and 21, 24, 240, 25, 26 and 26, and the cam 36 rests on the nozzle 13 as shown by thin lines in FIG. 5.

The tangential thrust between the jet and deflector 28, and which causes the return of the propelling tube, acts against the compression spring 34, and causes the lever 27 to move outwards.

This outward movement of the lever 27 also causes a simultaneous movement of the cam 36, which slides on the nozzle 13 by contacting it by means of the inclined portion 38.

An equilibrium position is therefore attained in which the extent of immersion of the deflector 28 into the jet reaches a desired value.

It should be noted that this stability is ensured even if the nozzle 13 is changed and the operating pressure varies.

Finally, it should be noted that the lowered position of the cam 36 represented by thin lines in FIG. 5 corresponds to small diameter nozzles 13, for example up to 14 mm, whereas for larger nozzles the position of complete lowering of the cam 36 is that shown by dotted lines.

I claim:

1. An impact irrigator which comprises a swing arm mounted for rotational movement, a rocker lever connected to said swing arm, said rocker lever being provided at its end portion with a return deflector, a nozzle means mounted on said rocker lever for creating a water jet, reversal linkage means operatively associated with said rocker lever for rocking said rocker lever between two positions, whereby the return deflector connected thereto is either completely outside the water jet or immersed in the water jet, said return deflector being elastically mounted through said rocker lever to elastic repositioning means whereby said return deflector is elastically positioned relative to said jet, such that the tangential thrust of the jet acting against the elastic repositioning means regulates the degree of impact or immersion of the return deflector in the water jet, said rocker lever being slidably mounted on its pivotal shaft in such a manner as to be able to move outwardly against the elastic repositioning means when the return deflector has become immersed in the water jet, said rocker lever being provided with a cam arranged to rest on the outlet nozzle of the jet in order to regulate the degree of vertical immersion of the return deflector as a function of the lateral movement of the rocker lever.

2. The impact irrigator as claimed in claim 1 characterized in that the means for the lateral sliding of the rocker lever comprise a sliding bearing housed in a chamber having an enlarged end portion, said chamber being rigidly connected at its other end with the rocker lever and a compression spring mounted on said pivotal shaft and disposed in said enlarged end portion between an anti-withdrawal ring on said pivotal shaft and said chamber.

3. The impact irrigator as claimed in claim 1 characterized in that the cam is disposed upstream of the return deflector, and is provided at its lower edge with a stepped profile which comprises at least one straight transverse portion, and a downwardly inclined portion, said cam being designed to rest on the nozzle.

4. The impact irrigator as claimed in claim 1 further comprising means for adjusting said cam relative to the rocker lever.

* * * * *